US005168792A

United States Patent [19]

Dugan

[11] Patent Number: 5,168,792

[45] Date of Patent: Dec. 8, 1992

[54] APPARATUS FOR MOUNTING A RODLESS CYLINDER

[75] Inventor: Larry M. Dugan, Boulder, Colo.

[73] Assignee: Coors Brewing Company, Golden, Colo.

[21] Appl. No.: 768,034

[22] Filed: Sep. 30, 1991

[51] Int. Cl.[5] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 4,545,290 | 10/1985 | Lieberman | 92/88 |
| 4,664,020 | 5/1987 | Kaiser | 92/88 |
| 4,785,716 | 11/1988 | Vaughn et al. | 92/88 X |
| 4,852,465 | 8/1989 | Roseneren | 92/88 |

FOREIGN PATENT DOCUMENTS

| | | | |
|---|---|---|---|
| 0104364 | 4/1984 | European Pat. Off. | 92/88 |
| 0294350 | 7/1988 | European Pat. Off. | 92/88 |

OTHER PUBLICATIONS

Norgren Martonair "Lintra Rodless Cylinder", 1987.

*Primary Examiner*—Edward K. Look
*Assistant Examiner*—Hoang Nguyen
*Attorney, Agent, or Firm*—Klaas, Law, O'Meara & Malkin

[57] ABSTRACT

A rodless cylinder and an external yoke which slides thereover are mounted in a relatively rigid generally tubular support that has a guide rail mounted thereon with a bearing slide mounted for sliding movement over the guide rail and the bearing slide has a work performing tool mounted thereon. The bearing slide is coupled to the external yoke for movement therewith and substantially all torques generated by forces on the work performing tool are absorbed by the bearing slide, the guide rail and the relatively rigid generally tubular support.

16 Claims, 2 Drawing Sheets

APPARATUS FOR MOUNTING A RODLESS CYLINDER

FIELD OF THE INVENTION

This invention relates generally to rodless cylinders and more particularly to a support apparatus for a rodless cylinder.

BACKGROUND OF THE INVENTION

Rodless cylinders, such as those marketed by Festo under the trade designation DGO Rodless Cylinders, and by SMC Pneumatic Inc. under the trade designation Series NCY1, have been available for several years. While these rodless cylinders have many advantages, there are some problem areas associated with the rodless cylinders. One problem area relates to the amount of force that can be applied on a work performing tool that is being moved by the housing which slides over the rodless cylinder. Since the driving connection between the housing and the movable piston in the rodless cylinder is magnetic, it is necessary to make the rodless cylinder with a very small wall thickness. This results in limiting the amount of force that can be placed on the work performing tool. Another problem area is that the rodless cylinders are used in an open work area so that they are exposed to the application of accidental force being applied thereon.

BRIEF DESCRIPTION OF THE INVENTION

This invention provides apparatus for mounting a rodless cylinder so that it is not exposed and has structures to absorb the torque generated by the force applied to a work performing tool being moved by the rodless cylinder so as to increase substantially the amount of force that can be placed on the work performing tool.

In a preferred embodiment of the invention, mounting means are provided for mounting a rodless cylinder, such as that marketed by FESTO under the trade designation DGO, comprising a hollow cylindrical shaft and a piston slidably mounted therein on a base support means at a relatively fixed location. An external yoke is mounted for sliding movement over the rodless cylinder. The mounting means comprise a relatively rigid generally tubular support having opposite end portions and a longitudinal axis; support means at each of the opposite end portions for supporting the rodless cylinder; an external guide rail mounted on the relatively rigid hollow support tube; slidable bearing means mounted on the external guide rail for sliding movement thereover; coupling means for coupling the slidable bearing means and the external yoke so that movement of the yoke moves the slidable bearing means and a work performing tool mounted on the slidable bearing means for movement therewith so that forces applied to the work performing tool will be absorbed by the slidable bearing means, the guide rail and the relatively rigid generally tubular support. The relatively rigid generally tubular support has a longitudinally extending slot formed therein and at least a portion of the coupling means extends through the longitudinally extending slot. The coupling means comprise a bracket mounted on the external yoke and located so that at least a portion thereof extends through the longitudinally extending slot; a plate member mounted on the slidable bearing means and connecting means for connecting the bracket and the plate member together so that the plate member moves with the bracket. The connecting means preferably comprise at least one weld, as described below. A first extension member extends from one of the opposite end portions of the rodless cylinder. An end cover is provided and has a circular hole extending therethrough. The first extension member passes through the circular hole and has at least a portion thereof projecting outwardly from the end cover. First securing means are provided for securing the end cover on the one of the opposite end portions of the rodless cylinder. A support member is provided and has a transverse cross-sectional configuration slightly smaller than the transverse cross-sectional configuration of the relatively generally tubular support so that the support member may be moved into the relatively rigid hollow support tube. The support member has a circular hole extending therethrough. A second extension member extends from the other of the opposite end portions of the rodless cylinder. The second extension member passes through the circular hole and has at least a portion thereof projecting outwardly from the support member. Second securing means are provided for securing the support member to the relatively rigid generally tubular support with at least portions of the end cover in contact with one of the opposite end portions of the relatively rigid hollow support tube. Mounting means are provided for mounting the other end portion of the rodless cylinder on the support member to permit movement of the other end portion of the rodless cylinder generally in radial directions relative to the support member. After the other end portion of the rodless cylinder has been secured on the relatively rigid support tube, the external yoke, the piston and the bearing slide are moved to the one of the opposite end portions and the bracket and the plate member ar welded together.

Another preferred embodiment of support means for mounting the rodless cylinder in a relatively rigid generally tubular support is in the form of a relatively rigid open sided support having a partial top wall, a full sidewall, a full bottom wall and a partial sidewall. The open sided tube is formed by bending a sheet of metal. An end support bracket is securely mounted on the partial top wall and the full sidewall. The end support bracket has a hexagonally shaped opening formed therein and an externally threaded first extension member of the rodless cylinder passes therethrough. A flange portion on the rodless cylinder abuts against one side of the opening and a threaded nut is tightened to secure the externally threaded first extension member on the end support bracket. A cover plate is secured to the partial sidewall and has a flange portion to cooperate with the partial top wall to form a slot. A guide rail is mounted on the partial top wall and a bearing slide is mounted on the guide rail for sliding movement thereover. A bracket is secured to the external yoke and a support plate is secured to the bearing slide. After the other end of the opposite end portions of the rodless cylinder has been secured to the relatively rigid open sided support, the external yoke, the piston and the bearing slide are moved to the one of the opposite end portions and the bracket is secured to the support plate by welding. This ensures the proper alignment between the bearing slide and the external yoke.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
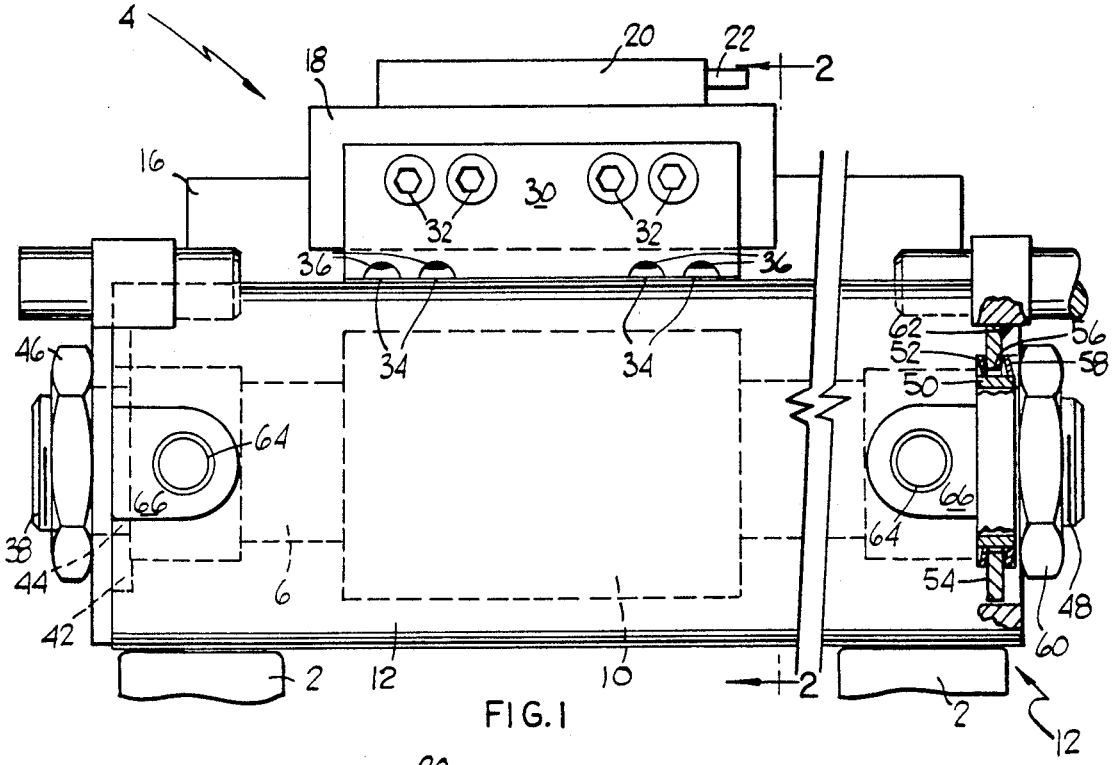
FIG. 1 is a side elevational view of a preferred embodiment of this invention.

In FIG. 1, there is illustrated base support means 2 and mounting means 4 for mounting a rodless cylinder comprising a hollow cylindrical shaft 6 and a piston 8 slidably mounted therein and on the base support means 2. An external yoke 10 is mounted for sliding movement over the rodless cylinder. The mounting means comprise a relatively rigid hollow support tube 12 which preferably has a rectangular transverse cross-sectional configuration and a longitudinal axis and is formed from steel plate having a thickness of about 0.25 inch. Support means are provided at each end of the relatively rigid hollow support tube 12 for mounting the hollow cylindrical shaft 6 in the relatively rigid hollow support tube 12. A guide rail 16 is mounted on the relatively rigid hollow support tube 12 and a bearing slide 18 is mounted on the guide rail 16 for sliding movement thereover. A support plate 20 is mounted on the bearing slide 18 and has a work performing tool 22, for applying a force, secured thereto for movement therewith. A longitudinally extending slot 24 is formed in the relatively rigid hollow support tube 12. A bracket 26 is mounted on the external yoke 10 using headed threaded bolts 28 and projects upwardly through the longitudinally extending slot 24 above the elongated rectangular tube 12. A plate member 30 is secured to the bearing slide 18 by headed threaded bolts 32. The bearing slide 18 and guide rail 16 are of the type marketed by THK Co. Ltd. under the trade designation SR-W/SR-V. Coupling means are provided so that movement of the bracket 26 moves the plate member 30. In a preferred embodiment of the invention, the plate member 30 has a plurality of cut-out portions 34 so that welds 36 may be formed to secure the plate member 30 and the bracket 26 together. This structure permits the bearing slide 18, the guide rail 16 and the elongated rectangular tube 10 to absorb the force being applied by the elongated rod 22. It ma be possible that the coupling means could comprise a pair of spaced apart fingers on the plate member 30 and a projecting boss on the bracket 26 located between the spaced apart fingers so that movement of the bracket 26 moves the plate member 30.

In FIG. 1, there is illustrated support means for mounting the hollow cylindrical shaft 6 in the relatively rigid hollow support tube 10. An externally threaded first extension member 38 extends outwardly from one end portion of the hollow cylindrical shaft 6. An end cover 40 has an integral reduced portion 42 that is dimensioned to fit snugly within the end portion of the relatively rigid hollow support tube 12. The end cover 40 has a central circular opening 44 so that the first extension member 38 may pass through the central opening 44 and a lock nut 46 is used to secure the end cover 40 on the one end portion of the hollow cylindrical shaft 6. An externally threaded second extension member 48 extends outwardly from the other end portion of the hollow cylindrical shaft 6. An annular spacer 50 is positioned over the second extension member 48. A first annular spring washer 52 is positioned over the annular spacer 50. A support member 54 having a transverse cross-sectional configuration corresponding to the transverse cross-sectional configuration of the relatively rigid hollow support tube 12 has a central circular opening 56 having a diameter greater than the diameter of the outer surface of the annular spacer 50 and is positioned so that at least a portion of the annular spacer 50 is located therein. Therefore, limited movement of the annular spacer 50 in the central opening 56 is permitted. A second annular spring washer 58 is positioned over the annular spacer 50. An internally threaded lock nut 60 is threaded onto the second extension member 48 and tightened until the annular spacer 50 is in contact with the other end portion of the rodless cylinder and the lock nut 60. The first and second annular spring washers 52 and 58 exert a resilient force on the support member 54 so that if an external force is applied to the other end portion of the rodless cylinder 6, the annular spacer 50 is moved to a new location and when the external force is removed, the first and second annular spring washers 52 and 58 will hold the annular spacer 50 at the new location. This permits centering of the hollow cylindrical shaft 6 in the relatively rigid hollow support tube 12. The above-described structures are assembled outside of the relatively rigid support tube 12. After assembly, the support member 54 is inserted into one end of the relatively rigid hollow support tube 12 and moved therethrough until the end cover 40 is in contact with the end of the relatively rigid hollow support tube 12. The support member 54 is then secured to the relatively rigid hollow support tube 12 by welding 62. The external yoke 10, the piston 8 and the bearing slide 18 are moved to the left side of FIG. 1 and the bracket 26 is secured to the plate member 30 by welding. This ensures the proper alignment of the bearing slide 18 and the external yoke 10. Fittings 64 are then mounted on each end portion of the rodless cylinder 6 so that they can be connected to a source of pressurized air (not shown) so as to move the piston 8. The fitting 64 pass through openings 66 formed in the relatively rigid hollow support tube 12.

Figure 2:
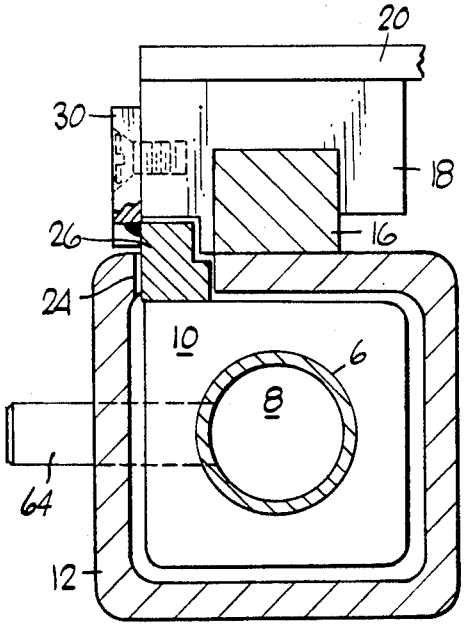
FIG. 2 is a cross-sectional view taken on the line 2—2 of FIG. 1.
Figure 3:
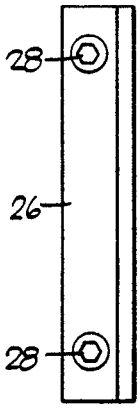
FIG. 3 is a top plan view of a portion of FIG. 2.
Figure 4:
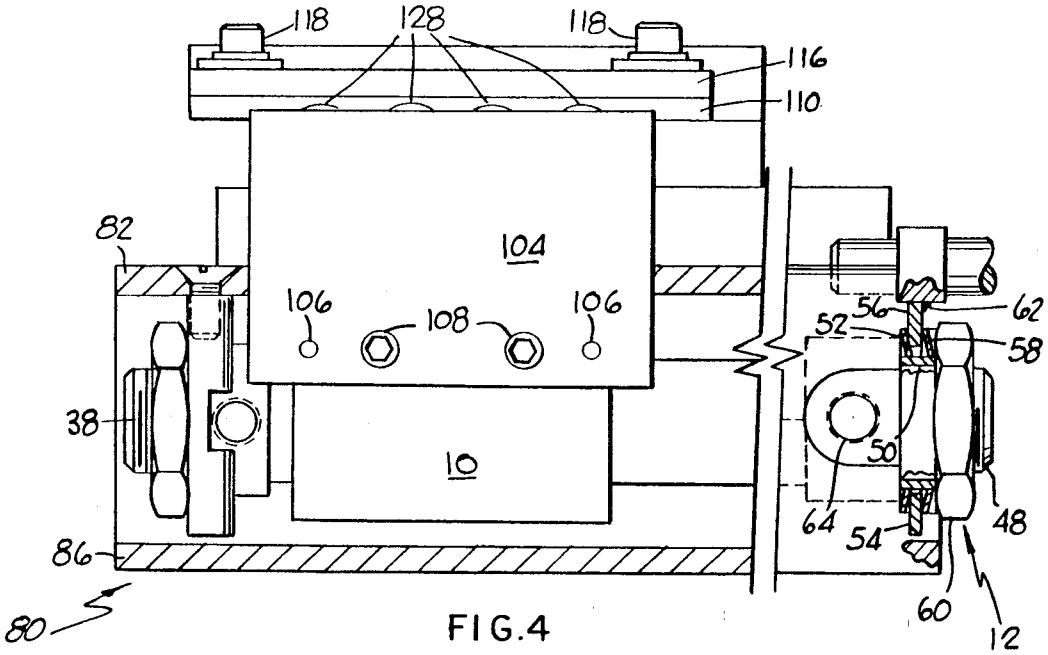
FIG. 4 is a view similar to FIG. 1 of another preferred support means for mounting the rodless cylinder.
Figure 6:
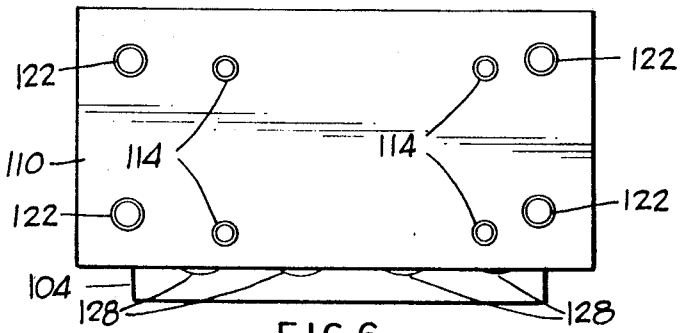
FIG. 6 is a top plan view with parts removed of a portion of FIG. 4.
Figure 5:
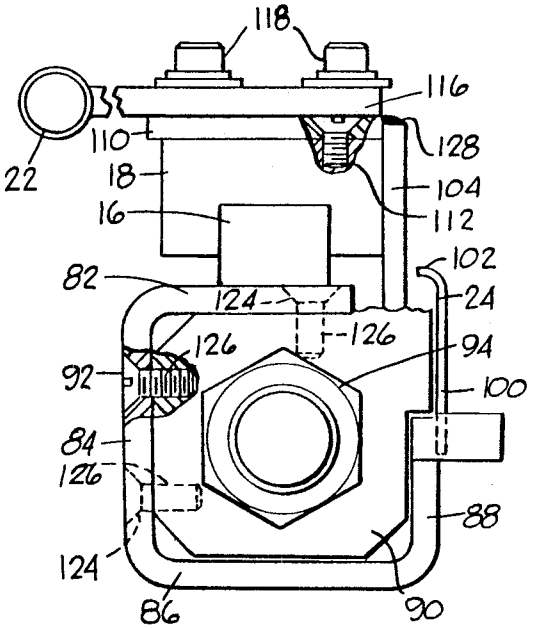
FIG. 5 is an end elevational view taken from the left side of FIG. 4.
Figure 7:
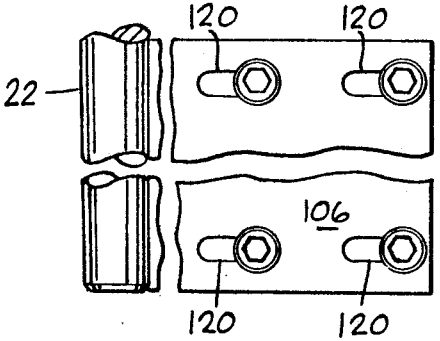
FIG. 7 is a top plan view with parts removed of a portion of FIG. 5.

In FIGS. 4–7, there is illustrated another preferred embodiment of support means for mounting the rodless cylinder in a relatively rigid generally tubular support in the form of a relatively rigid open sided support 80 having a partial top wall 82, a full sidewall 84, a full bottom wall 86 and a partial sidewall 88. The open sided tube is formed by bending a sheet of metal, such as steel plate having a thickness of about 0.25 inch. The structures in FIGS. 4–7 corresponding to those in FIGS. 1–3 will be given the same reference numerals. An end support bracket 90 is securely mounted on the partial top wall 82 and the full sidewall 84 using headed threaded bolts 92 and is spaced from the full bottom wall 86 and the partial sidewall 88. The end support bracket 90 has a hexagonally shaped opening 94 formed therein and an externally threaded first extension member 38 passes therethrough. A flange portion 96 abuts against one side of the opening 94 and a threaded nut 98 is tightened to secure the externally threaded first extension member 38 on the end support bracket 90. A cover plate 100 is secured to the partial sidewall 88 and has a flange portion 102 to cooperate with the partial top wall 82 to form the slot 24. A guide rail 16 is mounted on the partial top wall 82 and a bearing slide 18 is mounted on the guide rail 16 for sliding movement thereover. A bracket 104 is secured to the external yoke 10 using dowel pins 106 and threaded bolts 108. A support plate 110 is secured to the bearing slide 18 using headed threaded bolts 112 passing through openings 114 in the support plate 110. A plate member 116 is mounted on the support plate 110 using headed threaded bolts 11 passing through slots 120 and threaded into threaded openings 122 in the support plate 110. The work performing tool 22 is secured on the plate member 116. As described above relative to FIGS. 1-3, the above-described structures are assembled outside of the relatively rigid open sided support 80. After assembly, the support member 54 is inserted into one end of the relatively rigid open sided support 80 and moved therethrough until openings 124 in the partial top wall 82 and full sidewall 84 are aligned with threaded openings 126 in the end support bracket 108. The headed threaded bolts 92 are then used to secure the end support bracket 90 on the partial top wall 82 and the full sidewall 84 so that it is spaced from the full bottom wall 86 and the partial sidewall 88. The support member 54 is then secured to the relatively rigid open sided support tube 80 by welding 62 it to the partial top wall 82 and the full sidewall 84 so that it is spaced from the full bottom wall 86 and the partial sidewall 88. The external yoke 10, the piston 8 and the bearing slide 18 are moved to the left side of FIG. 4 and the bracket 104 is secured to the support plate 110 by welding 128. This ensures the proper alignment between the bearing slide 18 and the external yoke 10.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for mounting a rodless cylinder comprising:

a relatively rigid generally tubular support having opposite end portions and a longitudinal axis;

a rodless cylinder having opposite end portions;

an external yoke mounted for reciprocating sliding motion over said rodless cylinder;

support means at each of said opposite end portions for supporting said rodless cylinder;

an external guide rail mounted on said relatively rigid generally tubular support;

slidable bearing means mounted on said external guide rail for sliding movement thereover;

coupling means for coupling said slidable bearing means and said external yoke so that movement of said external yoke moves said slidable bearing means; and a work performing tool mounted on said slidable bearing means for movement therewith so that forces applied to said work performing tool are absorbed by said slidable bearing means, said guide rail and said relatively rigid generally tubular support.

2. The invention as in claim 1 and further comprising:

said relatively rigid generally tubular support having a longitudinally extending slot formed therein; and at least a portion of said coupling means extending through said longitudinally extending slot.

3. The invention as in claim 2 wherein said coupling means comprise:

a bracket mounted on said external yoke and located so that at least a portion thereof extends through said longitudinal extending slot;

a plate member mounted on said slidable bearing means; and securing means for securing said bracket and said plate member together so that said plate member moves with said bracket.

4. The invention as in claim 3 wherein said securing means comprise:

at least one weld.

5. The invention as in claim 2 and further comprising:

a first extension member on one of said opposite end portions of said rodless cylinder;

an end cover having a circular hole extending therethrough;

said first extension member passing through said circular hole and having at least a portion thereof projecting outwardly from said end cover;

first securing means for securing said end cover on one of said opposite end portions of said rodless cylinder;

a support member having a transverse cross-sectional configuration slightly smaller than the transverse cross-sectional configuration of said relatively rigid generally tubular support so that said support member may be moved into said relatively rigid generally tubular support;

said support member having a circular hole extending therethrough;

a second extension member on the other of said opposite end portions of said rodless cylinder;

said second extension member passing through said circular hole and having at least a portion thereof projecting outwardly from said support member;

second securing means for securing said support member to said relatively rigid generally tubular support with at least portions of said end cover in contact with one of said opposite end portions of said relatively rigid generally tubular support; and mounting means for mounting said other end portion of said rodless cylinder on said support member to permit movement of said other end portion of said rodless cylinder generally in radial directions relative to said support member.

6. The invention as in claim 5 wherein said mounting means for mounting said other end portion of said rodless cylinder on said support member comprise:

an annular spacer member mounted on said second extension member;

said annular spacer member having an outer diameter less than the inner diameter of said circular hole in said support member; and third securing means for securing said annular spacer member on said other of said opposite end portions of said rodless cylinder.

7. The invention as in claim 6 and further comprising:

resilient means mounted on said annular spacer member for applying a resilient force between said support member and said other of said opposite end portions of said rodless cylinder and between said support member and said third securing means to hold said annular spacer member at a relatively fixed position in said circular hole of said support member until moved by the application of an external force thereto.

8. The invention as in claim 7 wherein said coupling means comprise:

a bracket mounted on said external yoke and located so that at least a portion thereof extends through said longitudinally extending slot;

a plate member mounted on said slidable bearing means; and fourth securing means for securing said bracket and said plate member together.

9. The invention as in claim 8 wherein said fourth securing means comprise:

at least one weld.

10. The invention as in claim 2 wherein:

said relatively rigid generally tubular support has a rectangular transverse cross-sectional configuration and is formed from metal.

11. The invention as in claim 1 wherein said relatively rigid generally tubular support comprises:

an elongated partial top wall;

a full sidewall integral with said partial top wall;

a full bottom wall integral with said full sidewall;

a partial sidewall; and a cover plate secured to said partial sidewall and having a flange portion extending toward but spaced from said partial top wall to form a longitudinally extending slot therebetween.

12. The invention as in claim 11 and further comprising:

a first extension member on one of said opposite end portions of said rodless cylinder;

an end support having an opening extending therethrough;

said first extension member passing through said opening and having at least a portion thereof projecting outwardly from said end support;

first securing means for securing said end support on one of said opposite end portions of said rodless cylinder;

second securing means for securing said end support on said relatively rigid generally tubular support;

a support member having a transverse cross-sectional configuration slightly smaller than the transverse cross-sectional configuration of said relatively rigid generally tubular support so that said support member may be moved into said relatively rigid hollow support tube;

said support member having a circular hole extending therethrough;

a second extension member on the other of said opposite end portions of said rodless cylinder;

said second extension member passing through said circular hole and having at least a portion thereof projecting outwardly from said support member;

third securing means for securing said support member to said relatively rigid generally tubular support with at least portions of said end support secured to at least portions of said relatively rigid generally tubular support; and mounting means for mounting said other end portion of said rodless cylinder on said support member to permit movement of said other end portion of said rodless cylinder generally in radial directions relative to said support member.

13. The invention as in claim 12 wherein said mounting means for mounting said other end portion of said rodless cylinder on said support member comprises:

an annular spacer member mounted on said second extension member;

said annular spacer member having an outer diameter less than the inner diameter of said circular hole in said support member; and fourth securing means for securing said annular spacer member on said other of said opposite end portions of said rodless cylinder.

14. The invention as in claim 13 and further comprising:

resilient means mounted on said annular spacer member for applying a resilient force between said support member and said other of said opposite end portions of said rodless cylinder and between said support member and said third securing means to hold said annular spacer member at a relatively fixed position in said circular hole of said support member until moved by the application of an external force thereto.

15. The invention as in claim 14 wherein said coupling means comprise:

a bracket mounted on said external external yoke and located so that at least a portion thereof extends through said longitudinally extending slot;

a plate member mounted on said slidable bearing means; and fifth securing means for securing said bracket and said plate member together.

16. The invention as in claim 15 wherein said fifth securing means comprise:

at least one weld.

* * * * *